US005301639A

United States Patent [19]

Satou

[11] Patent Number: 5,301,639

[45] Date of Patent: Apr. 12, 1994

[54] VALVE TIMING CONTROL DEVICE FOR INTERNAL COMBUSTION ENGINE

[75] Inventor: Osamu Satou, Obu, Japan

[73] Assignee: Nippondenso Co., Ltd., Kariya, Japan

[21] Appl. No.: 81,095

[22] Filed: Jun. 25, 1993

[30] Foreign Application Priority Data

Jun. 26, 1992 [JP] Japan ..... 4-169670

[51] Int. Cl.[5] ..... F01L 1/34

[52] U.S. Cl. ..... 123/90.17; 123/90.31; 464/2; 74/568 R

[58] Field of Search ..... 123/90.15, 90.17, 90.31; 464/1, 2, 160; 74/567, 568 R

[56] References Cited

U.S. PATENT DOCUMENTS

| | | | |
|---|---|---|---|
| 4,787,345 | 11/1988 | Thoma | 123/90.17 |
| 4,856,465 | 8/1989 | Denz et al. | 123/90.17 |
| 5,012,773 | 5/1991 | Akasaka et al. | 123/90.17 |
| 5,058,539 | 10/1991 | Saito et al. | 123/90.17 |
| 5,113,814 | 5/1992 | Suga et al. | 123/90.17 |
| 5,144,921 | 9/1992 | Clos et al. | 123/90.17 |
| 5,209,193 | 5/1993 | Uchida et al. | 123/90.17 |
| 5,209,194 | 5/1993 | Adachi et al. | 123/90.17 |
| 5,215,046 | 6/1993 | Takenaka et al. | 123/90.17 |

FOREIGN PATENT DOCUMENTS

| | | | |
|---|---|---|---|
| 4037089 | 5/1992 | Fed. Rep. of Germany | 123/90.17 |
| 63-131808 | 6/1988 | Japan . | |
| 2-185607 | 7/1990 | Japan . | |
| 2-271009 | 11/1990 | Japan . | |
| 4-228813 | 8/1992 | Japan . | |
| 3628 | 3/1991 | PCT Int'l Appl. | 123/90.17 |

*Primary Examiner*—E. Rollins Cross
*Assistant Examiner*—Weilun Lo
*Attorney, Agent, or Firm*—Cushman, Darby & Cushman

[57] ABSTRACT

The invention provides a rotational phase adjustment device mounted on a rotation shaft and having a hydraulic chamber rotatable with this rotation shaft, in which operating fluid or oil can be supplied to the hydraulic chamber from a housing covering the rotational phase adjustment device. Also, the invention provides a rotational phase adjustment device which can be assembled easily, and particularly prevents damages to an oil seal, sealing a hydraulic chamber, when assembling the oil seal. A housing is attached to an engine to cover the whole of a valve timing control device, and a ring plate is secured to the housing by a bolt threaded into the ring plate from the outside of the housing, so that an oil seal mounted on an outer periphery of the ring plate is held in liquidtight sliding contact with a camshaft sleeve to form two oil passages respectively inside and outside of the camshaft sleeve. The two oil passages are independent of each other, and connect a hydraulic control valve to a pair of hydraulic chambers provided respectively on opposite sides of a hydraulic piston in an axial direction. Helical splines are formed on at least one of inner and outer surfaces of the hydraulic piston, and are engaged with splines formed on the camshaft sleeve and a sprocket sleeve. Therefore, by moving the hydraulic piston in the axial direction, a valve timing is changed.

17 Claims, 6 Drawing Sheets

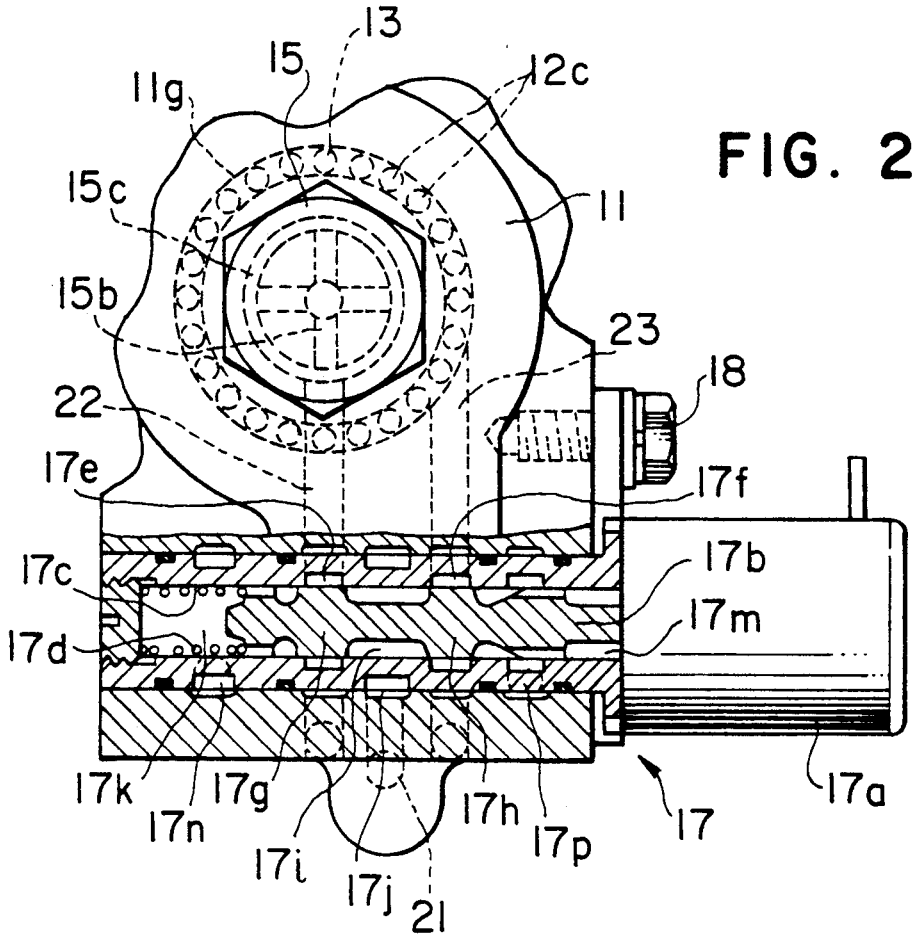
FIG. 2
FIG. 3
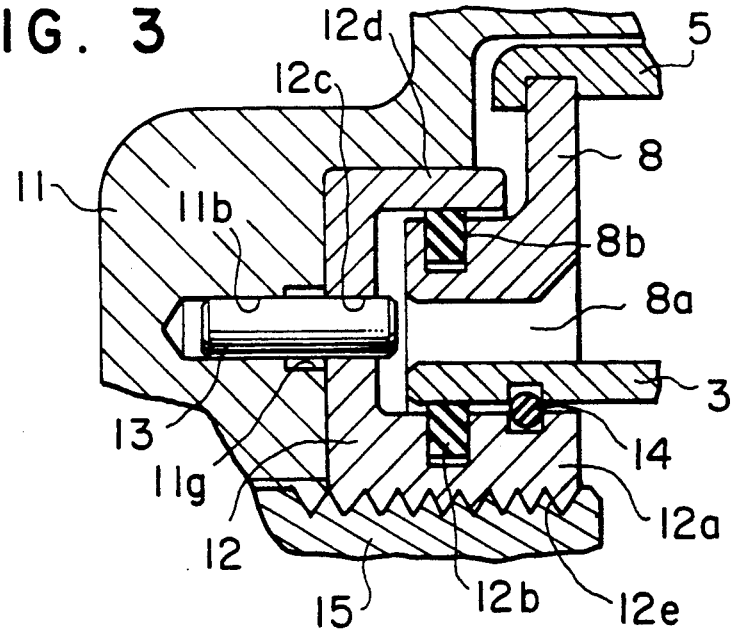

VALVE TIMING CONTROL DEVICE FOR INTERNAL COMBUSTION ENGINE

BACKGROUND OF THE INVENTION

This invention relates to a valve timing control device for varying the timing of opening and closing of intake and exhaust valves of an internal combustion engine in accordance with an operating condition of the engine, and more particularly to such a valve timing control device of the type which effects a valve timing control by means of hydraulic pressure.

A valve timing control device is disclosed, for example, in Japanese Patent Unexamined Publication No. 63-131808, in which in order to vary a valve timing of intake and exhaust valves in accordance with an operating condition of an internal combustion engine, within a hub of a timing pulley which is loosely fitted on a camshaft and is driven by a crankshaft through a timing belt, the timing pulley and the camshaft are provided with helical splines which are engaged with helical splines formed on at least one of the inside and outside of a tubular gear which is adjustably moved in an axial direction by a hydraulic pressure, and by moving the tubular gear back and forth in the axial direction by the hydraulic pressure, the timing pulley and the camshaft are rotated relative to each other.

In this conventional device, a hydraulic control valve is provided at the internal combustion engine body remote from the valve timing control device, and since pressurized oil needs to be supplied to a pair of hydraulic chambers provided respectively on the front and rear sides of the tubular gear, two oil passages are formed in a journal portion of the camshaft. As a result, not only the construction of the oil passages becomes complicated, but also in order to install the valve timing device, the camshaft, the journal portion and etc., of the internal combustion engine need to be extensively modified. And besides, the distance between the hydraulic control valve and each of the pair of hydraulic chambers is great, and they are interconnected by the oil passage formed in the journal portion of the camshaft and other portions, and therefore it is thought that a problem with respect to the response and reliability of the control is liable to arise.

To deal with this problem, Japanese Patent Unexamined Publication No. 2-271009 proposes a construction in which a hydraulic control valve is formed integral with a main portion of a valve timing control device. In this construction, however, since the hydraulic control valve is provided at an axial end portion of a camshaft, the overall length of the valve timing control device becomes great because of the provision of the hydraulic control valve. Therefore, there is produced a problem that a relatively large space is required for mounting the valve timing control device on the internal combustion engine and also for mounting such an internal combustion engine on an automobile.

To cope with these problems, the Assignee of the present application earlier proposed a valve timing control device in Japanese Patent Unexamined Publication No. 2-185607, in which instead of hydraulic pressure, pneumatic pressure (negative intake pressure) is utilized. A comparison between this device and the device of the present invention is rather insignificant because the former utilizes the pneumatic pressure; however, in this conventional device, when the valve timing device is to be mounted on the internal combustion engine, "an air passage beak" constituting an air passage needs to be mounted at the same time, and therefore if they should be assembled together incorrectly, the degradation of the air-tightness can be confirmed only after the valve timing control device is mounted on the internal combustion engine, and therefore much time and labor are needed for repair or correction. And besides, because of the nature of such a construction, a seal device for the pneumatic pressure is exposed, and therefore when tightening a bolt for fixing a pneumatic actuator to an end portion of a camshaft, parts of the seal device may be damaged by a wrench.

SUMMARY OF THE INVENTION

It is an object of this invention to provide a valve timing control device for controlling a valve timing by the use of hydraulic pressure, which device overcomes the above various problems of the prior art.

Another object of the invention is to provide a rotational phase adjustment device mounted on a rotating shaft and having a hydraulic chamber rotatable with this rotating shaft, in which operating fluid or oil can be supplied to the hydraulic chamber from a housing covering the rotational phase adjustment device.

A further object of the invention is to provide a rotational phase adjustment device which can be assembled easily, and particularly prevents damage to an oil seal, sealing a hydraulic chamber, when assembling the oil seal.

According to one aspect of the present invention, there is provided a rotational phase adjustment device for adjusting a rotational phase of an input shaft and an output shaft, comprising:

a stationary housing;

a tubular input member adapted for rotation with the input shaft;

a tubular output member adapted for rotation with the output shaft, said output member being coaxial with said input member, and there being formed an annular space between said input member and said output member;

a phase adjustment mechanism including a piston mounted within said annular space for movement in an axial direction of said input and output members, a hydraulic chamber being formed on one side of said piston in its axial direction, and said phase adjustment mechanism further including means for rotating said input member and said output member relative to each other in accordance with the movement of said piston in the axial direction;

a ring plate including an annular portion held in contact with an inner surface of said housing and fixed to said housing, and a pair of cylindrical rims extending axially from said annular portion;

a first oil seal provided between one of said pair of rims of said ring plate and said input member;

a second oil seal provided between the other rim of said ring plate and said output member; and oil passage means provided in said housing and said annular portion of said ring plate and communicated with said hydraulic chamber.

The hydraulic piston can be moved axially by feeding pressurized oil from a hydraulic control valve to one of the pair of hydraulic chambers so as to rotate the inner and outer sleeves relative to each other through splines formed on the hydraulic piston and the inner and outer sleeves, thereby varying a valve timing.

The ring plate is secured to the housing by a bolt threaded into the ring plate from the outside of the housing, and the ring plate is held in liquid-tight sliding contact with the inner sleeve through the oil seal. Therefore, merely by mounting the housing to cover the whole of the valve timing control device and then by fixing the ring plate to the housing by the bolt, the two oil passages independent of each other are formed respectively inside and outside of the inner sleeve, the two oil passages connecting the hydraulic control valve to the pair of hydraulic chambers provided respectively on the opposite sides of the hydraulic piston in an axial direction.

BRIEF DESCRIPTION OF THE DRAWINGS

FIG. 2 is a transverse cross-sectional view of the valve timing control device of FIG. 1;

FIG. 3 is an enlarged, cross-sectional view of an essential portion of the valve timing control device of FIG. 1;

DESCRIPTION OF THE PREFERRED EMBODIMENTS

Figure 1:
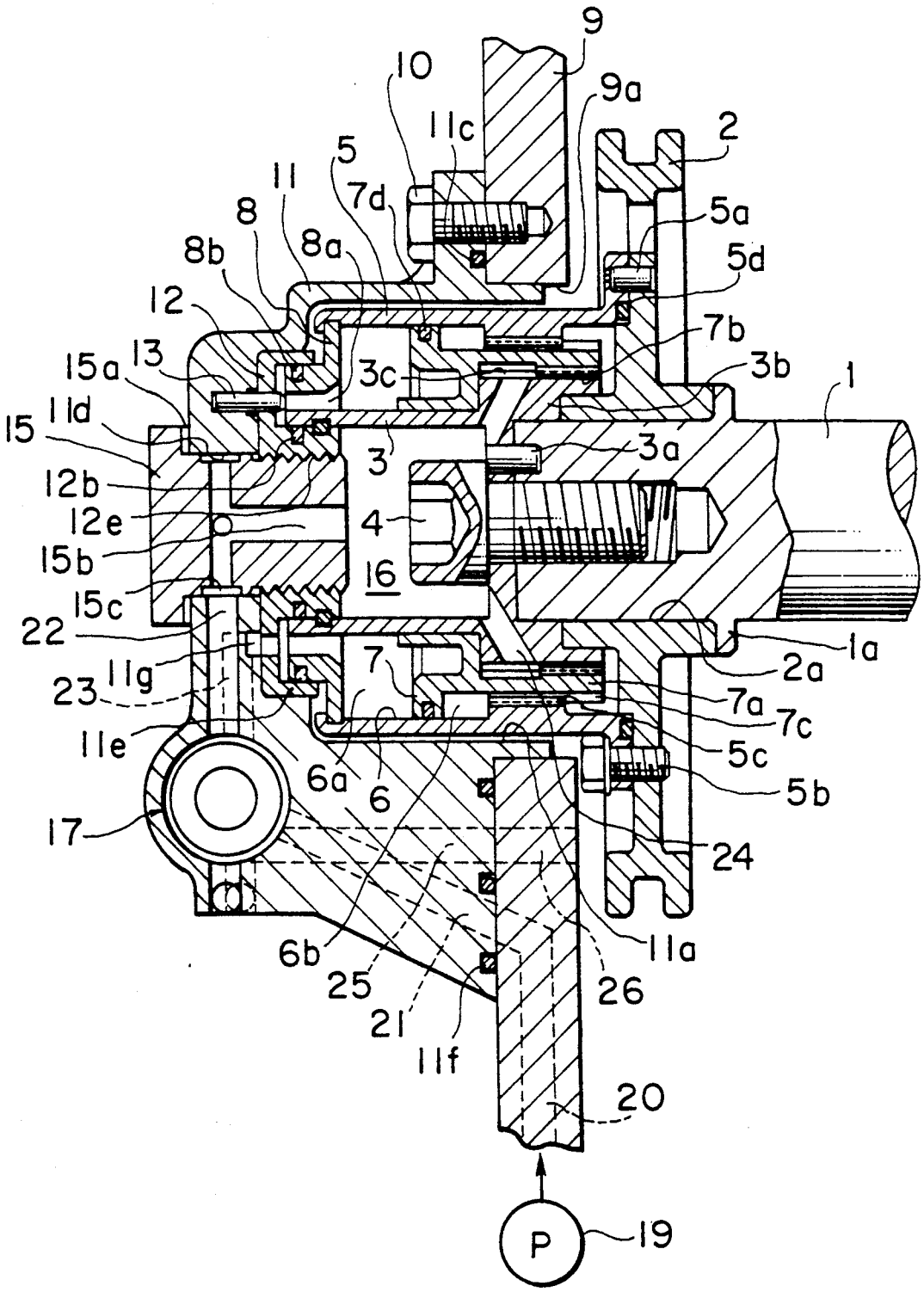
FIG. 1 is a front-elevational, cross-sectional view showing an overall construction of a valve timing control device according to a first embodiment of the present invention.

FIGS. 1 to 3 show a detailed construction of a valve timing control device according to a first embodiment of the present invention.

In FIG. 1 which shows an overall construction of the valve timing control device, the reference numeral 1 denotes a camshaft for opening and closing intake and exhaust valves (not shown) of an internal combustion engine, and the reference numeral 2 denotes a sprocket driven for rotation by a crankshaft (not shown) through a timing chain. The sprocket 2 may be replaced by a timing gear, a cogged pulley in mesh with a cogged belt, or the like, and therefore may be broadly referred to as "rotation transmission member".

The sprocket 2 is loosely fitted and supported at its central bore 2*a* on the camshaft 1, and is interposed between a flange la of the camshaft 1 and a camshaft sleeve 3 mounted on a distal end portion of the camshaft 1, so that the sprocket 2 is prevented from axial movement, but is rotatable relative to the camshaft 1. The camshaft sleeve 3 of a generally cylindrical shape is fixedly secured by a pin 3*a* and a bolt 4 to the camshaft 1 for rotation therewith.

A sprocket sleeve 5 of a generally cylindrical shape is integrally attached to the left side (FIG. 1) of the sprocket 2 by a pin 5*a* and a bolt 5*b*, the sprocket sleeve 5 being disposed coaxially with the camshaft 1. The reference numeral 5*d* denotes an O-ring for sealing purposes.

Internal helical splines 5*c* are formed on a part of an inner peripheral surface of the sprocket sleeve 5, and external helical splines 3*c* for the internal helical splines 5*c* are formed on an outer peripheral surface of a larger-diameter portion 3*b* of the camshaft sleeve 3, the external helical splines 3*c* having a helix angle in a direction opposite to that of a helix angle of the internal helical splines 5*c*. One of the external helical splines 3*c* and the internal helical splines 5*c* may be straight splines with a helix angle of zero extending in the axial direction.

An annular space 6 uniform in cross-section in the axial direction is formed between the camshaft sleeve 3 and the sprocket sleeve 5, and a hydraulic piston 7 of a generally cylindrical shape fits in the space 6 so as to slide liquid-tightly in the axial direction. Formed on a part of an inner surface of a sleeve 7*a* of the hydraulic piston 7 are internal helical splines 7*b* meshingly engaged with the external helical splines 3*c* of the camshaft sleeve 3. Also, external helical splines 7*c*, meshed with the internal helical splines 5*c* of the sprocket sleeve 5, are formed on an outer surface of the sleeve 7*a*. The reference numeral 7*d* denotes an annular oil seal for the hydraulic piston 7.

After the hydraulic piston 7 is inserted into the sprocket sleeve 5, an annular end plate 8 is secured to an open end (left end in FIG. 1) of the sprocket sleeve 5 by compressively deforming this open end. As shown in detail on an enlarged scale in FIG. 3, the peripheral wall of the end plate 8 has a generally L-shaped cross-section, and the end plate 8 has a large central hole 8*a*. An annular oil seal 8*b* is received in a groove formed in a shoulder portion of the end plate 8.

Thus, the annular space 6 between the camshaft sleeve 3 and the sprocket sleeve 5 is divided by the hydraulic piston 7 into two sections, that is, a first hydraulic chamber (left chamber in FIG. 1) 6*a* and a second hydraulic chamber (right chamber) 6*b*.

In the illustrated embodiment, almost all of the main component parts of the valve timing control device are accommodated within a housing 11 secured to a cylinder head 9 of the internal combustion engine by bolts 10. With this arrangement, the valve timing control device can be attached additionally to the engine, with the engine body being hardly modified. Moreover, advantageously, with this construction, the length of the passage of pressurized oil for effecting the control can be shortened to thereby enhance the response of the control, and also the reliability of the system can be enhanced. The housing 11 is fixedly secured to the cylinder head 9 at a position near the distal end of the camshaft 1, and covers the sprocket sleeve 5 with a slight gap formed therebetween in such a manner that the sprocket sleeve 5 can be rotated within a space 11*a* of a generally cylindrical shape communicated with an opening 9*a* formed through the cylinder head 9.

Before the housing 11 is attached to the cylinder head 9 to cover the sprocket sleeve 5, an annular ring plate 12 is attached in position, this ring plate 12 has a generally U-shaped transverse cross-section, that is, has a generally U-shaped groove. The ring plate 12 is attached in such a manner that the axially-extending, cylindrical shoulder portion of the end plate 8 and the camshaft sleeve 3 are received in the U-shaped groove of the ring plate 12. As shown in FIG. 3 on an enlarged scale, the ring plate 12 is engaged with the camshaft sleeve 3 through a stopper ring 14 in a manner to allow a relative rotation therebetween. The stopper ring 14 is fitted in a peripheral groove, formed in the inner peripheral surface of the camshaft sleeve 3 at the distal end portion thereof, and a peripheral groove formed in an outer periphery of an inner rim 12*a* of the ring plate 12. Before the ring plate 12 is attached in position, the stopper ring 14 is fitted in one of these two peripheral grooves. With this arrangement, the ring plate 12 is slightly movable relative to the camshaft sleeve 3 in the axial direction (that is, the ring plate 12 is movable a distance corresponding to the sum of the gap between the peripheral groove of the camshaft sleeve 3 and the stopper ring 14 and the gap between the stopper ring 14 and the peripheral groove of the ring plate 12), and is supported rotatably relative to the camshaft sleeve 3 and the sprocket sleeve 5. An oil seal **12*b* is mounted on the inner rim 12*a* of the ring plate 12, and is held in contact with the inner surface of the distal end portion of the camshaft sleeve 3, and an oil seal 8*b* is mounted on the shoulder portion of the end plate 8, and is held in contact with an inner surface of an outer rim 12*d* of the ring plate 12**, so that the pressurized oil is sealed against leakage.

After the ring plate 12 is mounted in the abovementioned manner, the housing 11 is attached to cover the component parts of the valve timing control device. A knock pin 13 is beforehand press-fitted in a hole **11*b* formed in the inner surface of the base portion of the housing 11. When the housing 11 is loosely fitted over the end plate 8, and is being inserted axially into the opening 9*a* in the cylinder head 9, the ring plate 12 is received in a guide wall 11*e* formed axially at the base portion of the housing 11. Then, the knock pin 13 is received in one of a number of holes 12*c* formed through the ring plate 12, thereby fixing the ring plate 12 to the housing 11 against rotation. A plurality of such knock pins may be provided. Since a number of holes 12*c* are formed through the ring plate 12, the knock pin 13 fixed to the housing 11 may fit in any one of the holes 12*c*, and this facilitates the assemblage. These holes 12*c*** are also used as a passage of pressurized oil, as later described.

The ring plate 12 mounted within the housing 11 closes the end of the annular space 6 between the camshaft sleeve 3 and the sprocket sleeve 5 in a manner to allow the rotation of these sleeves. Therefore, when the housing 11 is to be fastened to the cylinder head 9 by the bolts 10, the housing 11 is rotated about the axis of the camshaft 1 for the positioning purposes so that bolts holes in the housing 11 can be aligned respectively with their mating threaded holes in the cylinder head 9, and so that oil passageways formed in these parts can be connected together. Therefore, the sealing of the annular space 6 will not be degraded, which is one feature of the illustrated embodiment.

The reference numeral **11*c* denotes an O-ring which forms a seal around the opening 9*a* when the housing 11 is attached to the cylinder head 9**.

Internal threads **12*e* are formed on the inner periphery of the ring plate 12 which defines a central hole thereof, and the housing 11 has a hole 11*d* coaxial with this central hole. A bolt 15 having a relatively large diameter is passed through the hole 11*d* of the housing 11, and is threadedly engaged with the internal threads 12*e*. A seal ring 15*a* is fitted on a head portion of the bolt 15. Thus, at a final stage of the assemblage, the bolt 15 is passed through the hole 11*d* from the outside of the housing 11, and is threadedly engaged with the ring plate 12 to completely fix the ring plate 12 to the base portion of the housing 11. As a result, the distal ends (left ends in FIG. 1) of the camshaft sleeve 3 and the sprocket sleeve 5 are connected together through the ring plate 12 and the end plate 8, so that the left end of the annular space 6 is closed to form the first hydraulic chamber 6*a***.

It is to be noted that the ring plate 12 having the oil seal **12*b* is in sliding contact with the inner surface of the camshaft sleeve 3 to form a seal therebetween, so that two oil passages independently of each other are provided respectively inside and outside of the camshaft sleeve 3**.

The bolt 15 is inserted into the hole **11*d* from the outside of the housing 11, and is threadedly connected to the ring plate 12, so that a closed space 16 is formed within the camshaft sleeve 3 adjacent to the distal end of the camshaft 1. An oil passageway 15*b* of a T-shaped cross-section is formed in the bolt 15, and is communicated at its axial end with the space 16. An annular groove 15*c* is formed in the outer periphery of the bolt 15, and outer ends of a radially-extending portion of the oil passageway 15*b* of a T-shaped cross-section are communicated with this groove 15*c***. Thus, the passage for supplying and discharging the pressurized oil to perform a hydraulic control (later described) is formed.

All of the main component parts or elements of the valve timing control device are accommodated within the housing 11, and the passage of flow of the pressurized oil is shortened to enhance the response of the control, and also the overall axial length of the device is reduced, and therefore, a hydraulic control valve 17 of the electromagnetic type is integrally incorporated in the housing 11, and is disposed at a position offset from the axis of the camshaft 1. As shown in detail in FIG. 2, the hydraulic control valve 17 comprises a solenoid **17*a* serving as an actuator, and a valve spool 17*b* driven by the solenoid 17*a*. The solenoid 17*a* is fixedly secured to the housing 11 by a bolt 18. The valve spool 17*b* is inserted liquid-tightly in a valve cylinder 17*c* formed in the housing 11, and is urged in a right-hand direction (FIG. 2) by a spring 17*d*. By changing the intensity of electric current flowing through the solenoid 17*a*, the valve spool 17*b* is axially moved left an arbitrary distance against the bias of the spring 17*d*, so that land portions of the valve spool 17*b* open and close several valve ports formed in the valve cylinder 17*c***, thereby switching the oil passage.

Formed in the wall of the cylinder head 9 is an oil passageway 20 for oil (which may be lubricating oil) fed under pressure by a hydraulic pump (e.g. lubricating oil pump) which oil is used for effecting the control. The oil passageway 20 is connected to an oil passageway 21 which is formed in the housing 11 so as to feed the pressurized oil to the hydraulic control valve 17. An O-ring **11*f* for the sealing purposes is provided at the portion of connection between these oil passageways 20 and 21**.

Although the construction of the hydraulic control valve 17 is shown broadly in FIG. 2, the oil passageway 21 for the pressurized oil is always communicated with a pressurized oil space **17*i*, formed between two land portions 17*g* and 17*h* of the valve spool 17*b*, via a valve port 17*j* provided at the central portion of the valve cylinder 17*c* of the hydraulic control valve 17. Left and right valve ports 17*e* and 17*f*, which are opened and closed respectively by the land portions 17*g* and 17*f* in accordance with the position of the valve spool 17*b*, are connected respectively to oil passageways 22 and 23 formed in the housing 11**.

One oil passageway 22 is connected to the space 16 within the camshaft sleeve 3 via the annular groove **15*c* and the cross-sectionally T-shaped oil passageway 15*b*** formed in the bolt 15. The space 16 is communicated with the second hydraulic chamber 6b within the annular space 6 via an oil passageway 24.

The other oil passageway 23 is connected to an annular groove 11g formed in the inner surface of the housing 11 (which defines one end of the space 11a) on which the ring plate 12 is seated. The annular groove 11g is disposed generally in the same radial position relative to the axis of the camshaft 1 as that of a number of holes 12c formed through the ring plate 12. The hole 11b for the knock pin 13 is formed in the bottom of the annular groove 11g. With this arrangement, the annular groove 11g is connected to the central opening 8a of the end plate 8 via a number of holes 12c in the ring plate 12, so that the oil passageway 23 is always in communication with the first hydraulic chamber 6a of the annular space 6.

Left and right low-pressure spaces 17k and 17m, isolated from the central pressurized oil space 17i by the land portions 17g and 17h of the hydraulic control valve 17, are communicated via respective valve ports 17n and 17p with a drain passageway 25 (in some cases, the fluids from the spaces 17k and 17m are joined together at a portion (not shown)), and the drain passageway 25 is connected to a drain passageway 26 which is formed in the wall of the cylinder head 9 and is open to the interior of the cylinder head 9.

During the rotation of the internal combustion engine, so long as the position of the hydraulic piston 7 in the axial direction is not changed, the hydraulic piston 7 causes the sprocket 2 and the camshaft 1 to rotate in unison with each other by the engagement of the internal helical splines 7b and the external helical splines 7c respectively with the external helical splines 3c and the internal helical splines 5c, thus transmitting the rotation of the sprocket 2 to the camshaft 1. By slidingly moving the hydraulic piston 7 by the hydraulic pressure in the direction of the axis of the cam shaft 1 during the rotation, the position of engagement of the hydraulic piston 7 with the camshaft sleeve 3 and the sprocket sleeve 5 can be changed, so that the sprocket 2 and the camshaft 1 are rotated in opposite directions relative to each other along the splines.

Therefore, by controlling the axial position of the hydraulic piston 7 by the hydraulic pressure, the rotational phase of the camshaft 1 relative to the sprocket 2 and hence to the crankshaft can be adjusted in a stepless manner during the operation of the engine.

In this first embodiment, the hydraulic control mechanism for thus moving the hydraulic piston 7 in the axial direction of the camshaft 1 in a controlled manner has the above-mentioned construction. Therefore, by flowing electric current of an arbitrary intensity through the solenoid 17a of the hydraulic control valve 17 under the control of a control device (not shown), the valve spool 17b is brought into a position corresponding to the value of the applied electric current. When the solenoid 17a is supplied with electric current of a predetermined value, the valve spool 17b is disposed in a neutral position where the land portions 17g and 17h close the valve ports 17e and 17f, respectively, and this condition is shown in FIG. 1. In this condition, the position of the hydraulic piston 7 in the axial direction is not changed, and the valve timing of the camshaft 1 is not changed.

When the value of the electric current flowing through the solenoid 17a of the hydraulic control valve 17 is, for example, increased to move the valve spool 17b in the left-hand direction (FIG. 2), the left land portion 17g opens the valve port 17e, so that the pressurized oil space 17i, supplied with the pressurized oil from a hydraulic pump 19 via the oil passageways 20 and 21 and the valve port 17j, is brought into communication with the oil passageway 22 to feed the pressurized oil to the second hydraulic chamber 6b of the annular space 6 via the annular groove 15c, the cross-sectionally T-shaped oil passageway 15b, the space 16 and the oil passageway 24.

At the same time, the land portion 17h of the valve spool 17b opens the valve port 17f to communicate it with the low-pressure space 17m, so that the pressurized oil in the first hydraulic chamber 6a of the annular space 6 flows into the low-pressure space 17m via the hole 8a, the holes 12c, the annular groove 11g and the oil passageway 22, and further flows into the cylinder head 9 via the valve port 17p and the drain passageways 25 and 26.

As a result, the pressure within the second hydraulic chamber 6b becomes high whereas the pressure within the first hydraulic chamber 6a becomes low, and therefore the hydraulic piston 7 moves left in FIG. 1, so that a relative rotation occurs between the sprocket sleeve 5 and the camshaft sleeve 3 because of the action of the helical splines, and the valve timing of the camshaft 1 is varied, for example, to an advancing side.

When the valve timing advances a necessary angle, the electric current flowing through the solenoid 17a is returned to the initial value, and therefore the valve spool 17b is returned to the initial position, that is, the neutral position, and the land portions 17g and 17h close the valve ports 17e and 17f, respectively, thereby stopping the pressurized oil from flowing into and out of the first and second hydraulic chambers 6a and 6b. As a result, the hydraulic piston 7 is fixed in this position in the axial direction, and the valve timing obtained at this time is maintained.

In contrast, for delaying the valve timing, the value of the electric current flowing through the solenoid 17a is made lower than the level required for maintaining the valve spool 17b at the neutral position, so that the valve spool 17b is moved right in FIG. 2 in contrast with the case of advancing the valve timing. As a result, the pressurized oil space 17i is connected to the first hydraulic chamber 6a via the valve port 17f to increase the pressure within the first hydraulic chamber 6a. At the same time, the valve port 17e is brought into communication with the low-pressure space 17k to connect the second hydraulic chamber 6b to the interior of the cylinder head 9 to decrease the pressure within the second hydraulic chamber 6b. As a result, the hydraulic piston 7 moves right (FIG. 1) in the axial direction, thereby delaying the valve timing.

In order that after the valve timing is delayed a necessary angle, this valve timing can be maintained, the electric current flowing through the solenoid 17a is returned to the initial value to return the valve spool 17b to the neutral position, thereby holding the hydraulic circuit in an interrupted condition.

In this embodiment, since the hydraulic control valve 17 is mounted in the housing 11, the pressurized oil controlled by the hydraulic control valve 17 is fed directly to the first hydraulic chamber 6a or the second hydraulic chamber 6b without passing through the cylinder head 9 of the internal combustion engine. Therefore, the controllability and the responsibility are enhanced, and besides the valve timing control device is independent of the internal combustion engine, and can be attached to and detached from the internal combustion engine as a block. Moreover, it is not necessary to apply to the internal combustion engine such a modification as an additional formation of passageways for the pressurized oil in a journal portion (not shown) of the camshaft 1, and the valve timing control device can be quite easily attached additionally to the engine, and therefore the overall construction of the internal combustion engine can be simplified.

In the ring plate 12 which is one feature of this first embodiment, the oil seal 8*b* and the oil seal 12*b* are disposed generally in a common plane perpendicular to the axis of the camshaft 1 in concentric relation to each other, and therefore the overall length of the valve timing control device in the axial direction is shortened, so that the amount of projection of this device from the cylinder head 9 of the internal combustion engine is reduced.

Figure 4:
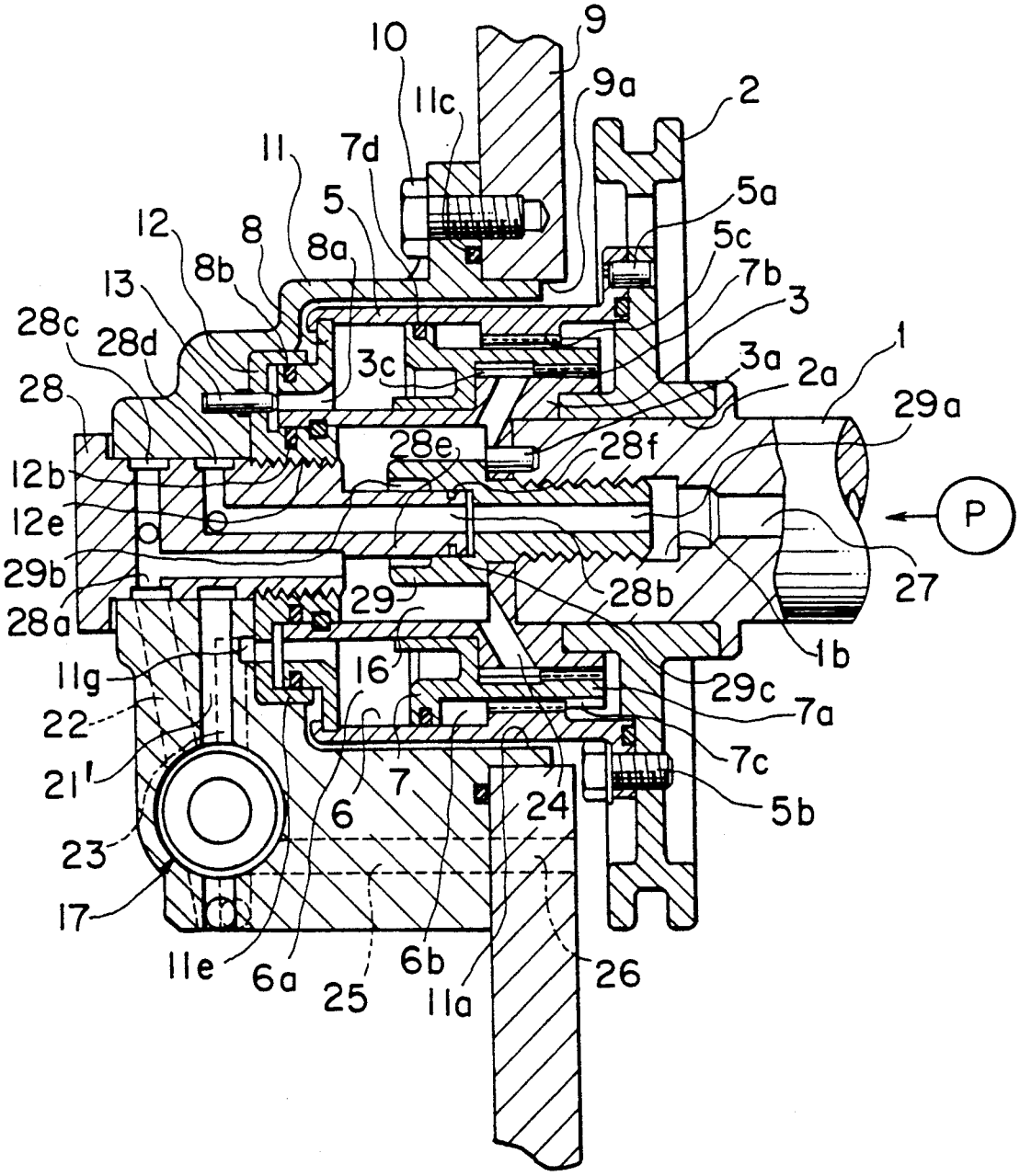
FIG. 4 is a view similar to FIG. 1, but showing a valve timing control device according to a second embodiment of the present invention.
Figure 5:
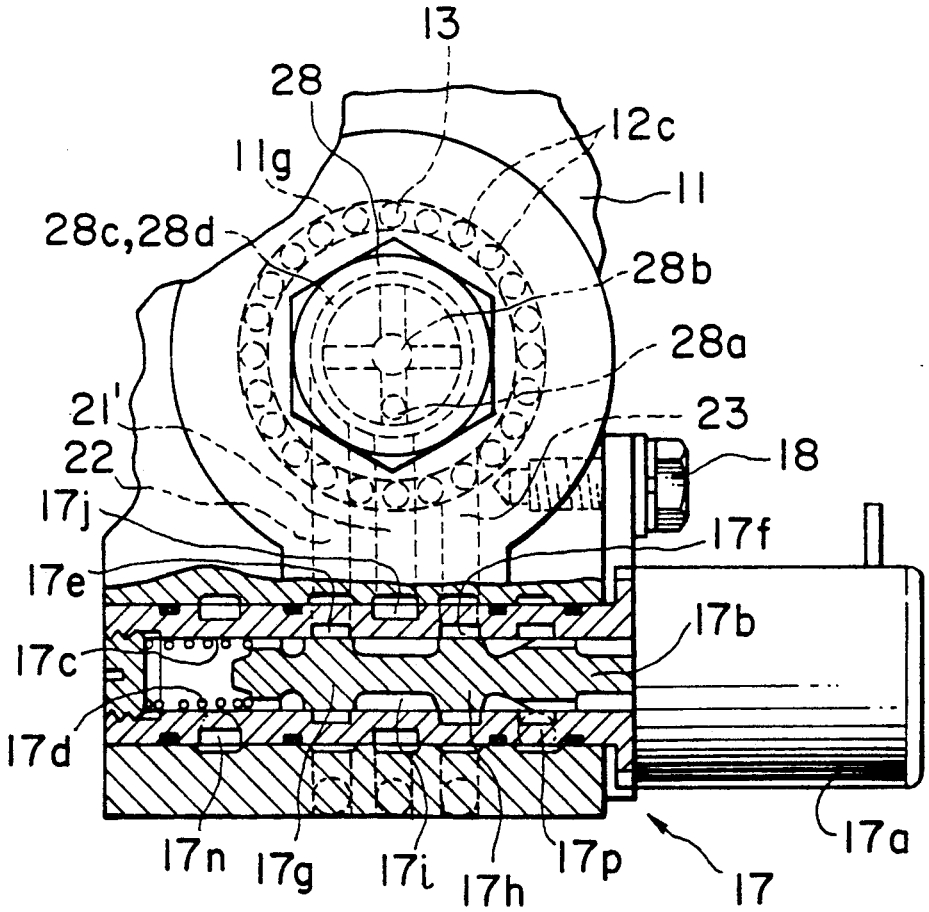
FIG. 5 is a transverse cross-sectional view of the valve timing control device of FIG. 4.

FIGS. 4 and 5 show a second embodiment of the present invention. In this second embodiment, part of pressurized lubricating oil (which lubricates a valve mechanism of an internal combustion engine) flowing through a lubricating oil passageway 27 (which is commonly provided in conventional engines) formed axially centrally in a camshaft 1 is used as pressurized oil for controlling a valve timing. In the above-mentioned first embodiment, the lubricating oil for the internal combustion engine can also be utilized; however, in the second embodiment, the lubricating oil pressurized by a lubricating oil pump of the internal combustion engine can be easily taken out merely by creating a hole in the axial end of the camshaft 1.

Where the lubricating oil passageway 27 in the camshaft 1 is thus utilized, there is a possibility that difficult problems may be encountered with oil passages for feeding the pressurized oil to the valve timing control device and also with seal devices for preventing leakage between sliding parts. In this second embodiment of the invention, however, these problems are suitably overcome by threading a bolt 28 into a housing 11 of the valve timing control device from the outside of the housing 11, as is the case with the bolt 15 in the first embodiment, the bolt 28 having two oil passageways connected respectively to a pair of hydraulic chambers 6*a* and 6*b*.

More specifically, the bolt 28 of a unique construction is threaded into internal threads 12*e* on an inner periphery of a ring plate 12 substantially identical in construction to the ring plate 12 of the first embodiment shown in FIGS. 1 and 3. As shown in FIGS. 4 and 5, the two oil passageways 28*a* and 28*b* are formed in the bolt 28. The two oil passageways 28*a* and 28*b* are communicated respectively with annular grooves 28*c* and 28*d* which are formed in the outer periphery of the bolt 28 adjacent to a proximal end of the bolt 28 and are spaced from each other axially of the bolt 28. Like the cross-sectionally T-shaped oil passageway 15*b* and the annular groove 15*c* in the bolt 15, the oil passageway 28*a* and the annular groove 28*c* communicate an oil passageway 22 from a hydraulic control valve 17 with a space 16 within a camshaft sleeve 3, and perform a function similar to that of the passageway 15*b* and the annular groove 15*c*. The oil passageway 28*b* and the annular groove 28*d* are specially provided in the bolt 28 of the second embodiment.

As clearly shown in FIG. 4, a bolt 29 is threaded into an internally-threaded hole lb formed in the end portion of the camshaft 1 and extending from the oil lubricating passageway 27. Although the bolt 29 is different in shape from the bolt 4 of the first embodiment, one purpose of the bolt 29 is the same as that of the bolt 4, that is, to fix a camshaft sleeve 3 and so on to the end portion of the camshaft 1. When the bolt 29 is threaded into the camshaft 1, a through hole 29*a* in the bolt 2, as well as a cylindrical recess 29*c* extending from a hexagonal recess 29*b* formed in a bolt head for receiving a wrench, is communicated with the lubricating oil passageway 27 in the camshaft 1.

A cylindrical portion 28*e* with a relatively small diameter formed at a distal end of the bolt 28 is inserted in the cylindrical recess 29*c*, and a liquid-tight seal is formed by an oil seal 28*f* mounted on the periphery of the cylindrical portion 28*e*. In the second embodiment, an oil passageway 21', which is formed in the housing 11 and is communicated with a pressurized oil space 17*i* of the hydraulic control valve 17, is connected to the annular groove 28*d*, and with this arrangement, the pressurized oil is fed from the lubricating oil passageway 27 in the camshaft 1 to a valve port 17*j* sequentially via the through hole 29*a* of the bolt 29, the oil passageway 28*b* of the bolt 28, the annular groove 28*d* and the oil passageway 21'. Therefore, in the second embodiment, except for the above special effect achieved by the provision of the different pressurized oil supply source and the different oil supply passage, effects generally similar to those of the first embodiment are achieved.

Figure 6:
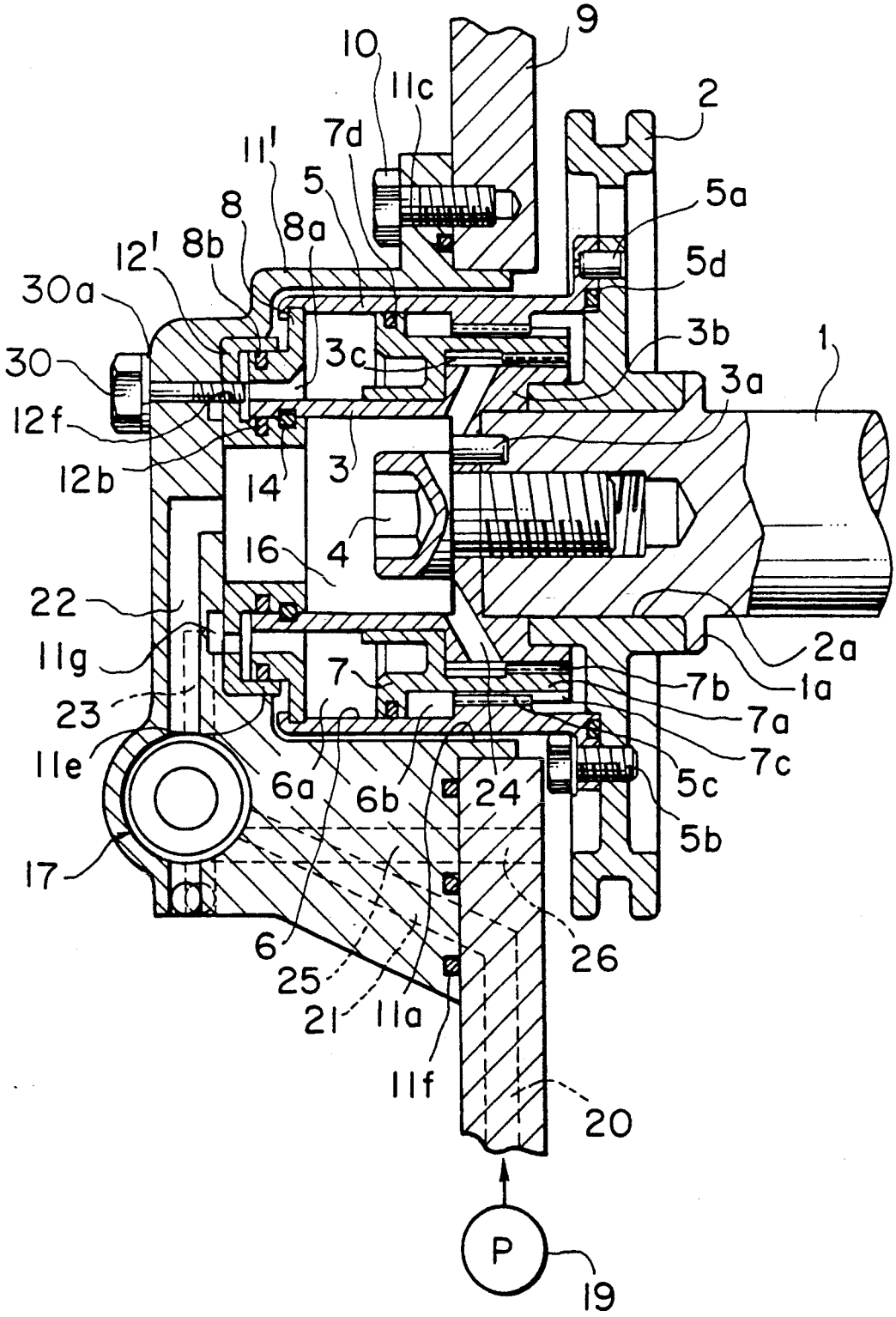
FIG. 6 is a view similar to FIG. 1, but showing a valve timing control device according to a third embodiment of the present invention.
Figure 7:
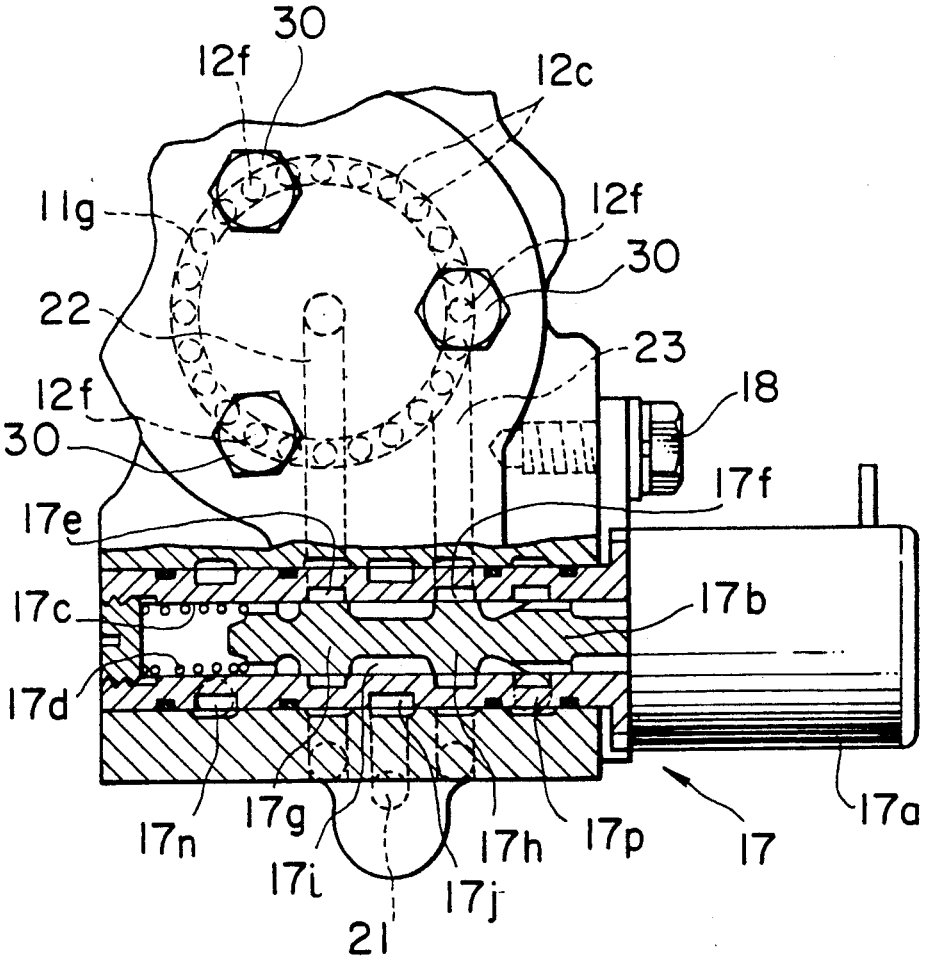
FIG. 7 is a transverse cross-sectional view of the valve timing control device of FIG. 6.

FIGS. 6 and 7 shows a third embodiment of the present invention. In this embodiment, the bolt 15 and the knock pin 13 used in the first embodiment are not used, and instead three bolts 30 of a relatively small size are inserted respectively into through holes 11*h* in a housing 11' from the outside of this housing, and are threaded respectively into internally-threaded holes 12*f* provided by forming internal threads at some of a number of holes 12*c* formed in a ring plate 12', thereby fixing the ring plate 12' within the housing 11'.

In the third embodiment, the ring plate 12' is not fixed by the use of a single bolt as in the first embodiment in which the ring plate is fixed by the single bolt 15 threaded into the central portion of the ring plate. Therefore, it is not necessary to provide the internal threads (as at 12*e* in the first embodiment) at a central hole 12*g* of the ring plate 12'. And besides, an oil passageway 22 leading to a hydraulic control valve 17 can be communicated with a space 16 within a camshaft sleeve 3 via the central hole 12*g* of the ring plate 12', and therefore the construction of this portion can be made simpler than that of the first embodiment. A seal washer 30*a* is fitted on the small bolt 30 adjacent to a head thereof for forming a liquid-tight seal. As in the first embodiment, a pressurized oil supply circuit utilizes an oil passageway 20, formed in a wall of a cylinder head 9, and an oil passageway 21 formed in the housing 11'.

In the valve timing control devices of the present invention, the construction of the oil passage is simplified, and when the valve timing control device is to be mounted on the engine, it is not necessary to extensively modify the internal combustion engine. And besides, the distance between the hydraulic control valve and each of the pair of hydraulic chambers is small, and because of the provision of the ring plate fixedly mounted within the housing of the valve timing control device by the bolt or bolts threaded into the ring plate from the outside of the housing, the two oil passages (which are independent of each other) for interconnecting the hydraulic control valve and the hydraulic chambers can be quite easily formed inside and outside the sleeve integral with the camshaft. Therefore, the valve timing control device can be easily attached to the internal combustion engine, and the response of the control as well as the reliability is enhanced, and there is no need to provide any oil passageway in the journal portion of the camshaft and etc., of the internal combustion engine.

The hydraulic control valve is mounted in the valve timing control device, and is disposed at a position offset from the longitudinal axis of the camshaft, and therefore the valve timing control device can have a compact overall construction, and the engine with the valve timing control device can be mounted more easily.

What is claimed is:

1. A rotational phase adjustment device for adjusting a rotational phase of an input shaft and an output shaft, comprising:

a stationary housing;

a tubular input member adapted for rotation with the input shaft;

a tubular output member adapted for rotation with the output shaft, said output member being coaxial with said input member, and there being formed an annular space between said input member and said output member;

a phase adjustment mechanism including a piston mounted within said annular space for movement in an axial direction of said input and output members, a hydraulic chamber being formed on one side of said piston in its axial direction, and said phase adjustment mechanism further including means for rotating said input member and said output member relative to each other in accordance with the movement of said piston in the axial direction;

a ring plate including an annular portion held in contact with an inner surface of said housing and fixed to said housing, and a pair of cylindrical rims extending axially from said annular portion;

a first oil seal provided between one of said pair of rims of said ring plate and said input member;

a second oil seal provided between the other rim of said ring plate and said output member; and oil passage means provided in said housing and said annular portion of said ring plate and communicated with said hydraulic chamber.

2. A rotational phase adjustment device according to claim 1, further comprising a hydraulic control valve mounted in said housing for feeding pressurized oil to said hydraulic chamber via said oil passage means for moving said piston in the axial direction.

3. A rotational phase adjustment device according to claim 2, in which said hydraulic control valve is disposed at a position offset from the axis of said input shaft.

4. A rotational phase adjustment device according to claim 2, in which an oil passageway is formed axially in said input shaft for feeding lubricating oil to said hydraulic control valve.

5. A rotational phase adjustment device for adjusting a rotational phase of an input shaft and an output shaft, comprising:

a stationary housing;

a tubular input member adapted for rotation with the input shaft;

a tubular output member adapted for rotation with the output shaft, said output member being coaxial with said input member, and there being formed an annular space between said input member and said output member;

a phase adjustment mechanism including a piston mounted within said annular space for movement in an axial direction of said input and output members, a pair of hydraulic chambers being formed respectively on opposite sides of said piston in its axial direction, and said phase adjustment mechanism further including means for rotating said input member and said output member relative to each other in accordance with the movement of said piston in the axial direction;

a ring plate including an annular portion held in contact with an inner surface of said housing and fixed to said housing, and a pair of cylindrical rims extending axially from said annular portion;

a first oil seal provided between one of said pair of rims of said ring plate and said input member;

a second oil seal provided between the other rim of said ring plate and said output member;

first oil passage means provided in said housing and said annular portion of said ring plate and communicated with one of said pair of hydraulic chambers; and second oil passage means separated by said ring plate from said first oil passage means and communicated with the other hydraulic chamber.

6. A valve timing control device for mounting on an end portion of a camshaft, driving valves of an internal combustion engine, for changing a rotational phase of the camshaft, comprising:

an inner tubular sleeve adapted to be fixedly mounted on an end portion of the camshaft;

an outer tubular sleeve adapted to be rotatably mounted on the camshaft, said outer sleeve being provided around said inner sleeve and the end portion of said camshaft, and there being formed an annular space between said inner sleeve and said outer sleeve;

a piston mounted within said annular space for interconnecting said inner and outer sleeves in a direction of rotation of said sleeves, said piston being movable in an axial direction to rotate said inner and outer sleeves relative to each other, a pair of first and second hydraulic chambers being formed respectively on opposite sides of said piston in its axial direction, said first hydraulic chamber being disposed remote from the camshaft, and said second hydraulic chamber being disposed close to the camshaft;

a stationary housing;

a ring plate including an annular portion held in contact with an inner surface of said housing and fixed to said housing, and a pair of first and second tubular rims extending axially from said annular portion;

a first oil seal provided between said first rim of said ring plate and said inner sleeve;

a second oil seal provided between said second rim of said ring plate and said outer sleeve;

first oil passage means provided in said housing and said annular portion of said ring plate and communicated with said first hydraulic chamber; and second oil passage means separated by said ring plate from said first oil passage means and communicated with the second hydraulic chamber.

7. A device according to claim 6, further comprising a hydraulic control valve mounted in said housing for varying a pressure within said first hydraulic chamber via said first oil passage means and for varying a pressure within said second hydraulic chamber via said second oil passage means, so as to move said hydraulic piston in the axial direction.

8. A device according to claim 7, in which said hydraulic control valve is disposed at a position offset from the axis of said camshaft.

9. A device according to claim 7, in which an oil passageway is formed axially in said camshaft for feeding a lubricating oil to said hydraulic control valve.

10. A device according to claim 1 or 5, in which said piston is of a tubular shape, and has inner and outer helical splines formed respectively on inner and outer peripheries of said piston, said input member having helical splines formed on an inner periphery thereof, said output member having helical splines formed on an outer periphery thereof, and said inner and outer helical splines of said piston being engaged respectively with said helical splines of said output member and said helical splines of said input member, so that when said piston is moved in the axial direction, said input member and said output member are rotated relative to each other in opposite directions through said engaged helical splines.

11. A device according to claim 1 or 5, in which said first oil seal and said second oil seal are disposed generally in a common plane substantially perpendicular to the axis of said input shaft.

12. A device according to claim 1, claim 5 or claim 6, in which said ring plate is fixedly secured to said housing by a bolt passed through a wall of said housing from the outside of said housing and threaded into said ring plate.

13. A device according to claim 5, further comprising a hydraulic control valve mounted in said housing for varying a pressure within said first hydraulic chamber via said first oil passage means and for varying a pressure within said second hydraulic chamber via said second oil passage means, so as to move said hydraulic piston in the axial direction.

14. A device according to claim 13, in which said hydraulic control valve is disposed at a position offset from the axis of said input shaft.

15. A device according to claim 13, in which an oil passageway is formed axially in said input shaft for feeding a lubricating oil to said hydraulic control valve.

16. A device according to claim 6, in which said piston is of a tubular shape, and has inner and outer helical splines formed respectively on inner and outer peripheries of said piston, said inner tubular sleeve having helical splines formed on an inner periphery thereof, said outer tubular sleeve having helical splines formed on an outer periphery thereof, and said inner and outer helical splines of said piston being engaged respectively with said helical splines of said outer tubular sleeve and said helical splines of said inner tubular sleeve, so that when said piston is moved in the axial direction, said inner tubular sleeve and said outer tubular sleeve are rotated relative to each other in opposite directions through said engaged helical splines.

17. A device according to claim 6, in which said first oil seal and said second oil seal are disposed generally in a common plane substantially perpendicular to the axis of said camshaft.

* * * * *